US009655416B1

(12) United States Patent
Clarke

(10) Patent No.: US 9,655,416 B1
(45) Date of Patent: May 23, 2017

(54) CRANK HANDLE POSITIONING ASSEMBLY FOR AN UMBRELLA

(71) Applicant: Dougan H. Clarke, Miami, FL (US)

(72) Inventor: Dougan H. Clarke, Miami, FL (US)

( * ) Notice: Subject to any disclaimer, the term of this patent is extended or adjusted under 35 U.S.C. 154(b) by 0 days.

(21) Appl. No.: 14/711,341

(22) Filed: May 13, 2015

Related U.S. Application Data

(60) Provisional application No. 61/992,557, filed on May 13, 2014.

(51) Int. Cl.

| | |
|---|---|
| ***A45B 25/14*** | (2006.01) |
| ***F16H 57/021*** | (2012.01) |
| ***F16H 57/038*** | (2012.01) |
| ***F16H 25/20*** | (2006.01) |

(52) U.S. Cl.
CPC ..... *A45B 25/14* (2013.01); *F16H 25/20* (2013.01); *F16H 57/021* (2013.01); *F16H 57/038* (2013.01); *A45B 2025/146* (2013.01); *F16H 2025/2093* (2013.01)

(58) Field of Classification Search
CPC ... A45B 25/14; A45B 2025/146; A45B 25/00; A45B 23/00; F16H 25/20; F16H 57/01; F16H 2025/2093
USPC ..... 135/15.1, 20.1, 20.3, 25.4, 16, 98; 242/395, 283.8; 116/173
See application file for complete search history.

(56) References Cited

U.S. PATENT DOCUMENTS

| | | | |
|---|---|---|---|
| 132,054 | A | 10/1872 | Coan et al. |
| D14,944 | S | 4/1884 | Drown |
| 466,012 | A | 12/1891 | Seaman |
| D25,368 | S | 4/1896 | Sparry |
| 579,185 | A | 3/1897 | Shaine |
| 695,663 | A | 3/1902 | Weirich |
| 760,598 | A | 5/1904 | Wynegar |
| 786,471 | A | 4/1905 | Wallace |

(Continued)

FOREIGN PATENT DOCUMENTS

| | | |
|---|---|---|
| CA | 2641715 | 8/2007 |
| DE | 29622123 U1 | 2/1997 |

(Continued)

OTHER PUBLICATIONS

Cuetec Vortex, The Ultimate Cue Shaft, Mar. 1, 2006 www.cuetec.net.

*Primary Examiner* — Winnie Yip
(74) *Attorney, Agent, or Firm* — Malloy & Malloy, P.L.

(57) ABSTRACT

A crank handle positioning assembly structured to selectively position a mast mounted canopy of an umbrella into and between open and closed orientations. A gear housing is disposed within the interior of the mast in at least partially enclosing relation to a gear assembly and in driving relation to at least one elongated drive gear. A crank handle is disposed on an exterior of the mast and extends therethrough into rotationally driving relation to the gear assembly. A rider member is interconnected in driving relation to the canopy assembly and is reciprocally movable along the length of the drive gear upon rotational, driving engagement of the crank handle with the gear assembly. Concurrent, cooperative directions of linear movement of the rider member and a rotational movement of the crank handle is determinative of the positioning of the canopy assembly in either the open or closed orientations.

25 Claims, 7 Drawing Sheets

(56) References Cited

U.S. PATENT DOCUMENTS 886,659 A 5/1908 Sprague
1,008,743 A 3/1914 Swinland
D47,246 S 4/1915 Liedberg
D47,559 S 7/1915 Henderson
1,167,431 A 1/1916 Raabe
1,241,194 A 9/1917 Carlson et al.
1,328,175 A 1/1920 Martin
D56,043 S 8/1920 Weinberg et al.
1,411,560 A 4/1922 Beaty
1,673,677 A 6/1928 Holland
1,702,292 A 2/1929 Barrett
1,801,913 A 4/1931 Frederick
2,005,699 A 6/1935 Gottwald
2,097,600 A 11/1937 Pavlecka
D115,071 S 5/1939 Rosenberg
2,172,549 A 9/1939 Solomon
2,230,898 A 2/1941 MacFadden
2,319,118 A 5/1943 Farkas et al.
2,336,116 A 12/1943 Morando
2,350,475 A 6/1944 Rabezzana
2,396,747 A 3/1946 Parrott
2,607,363 A * 8/1952 Frey ..... A45B 17/00 135/74
2,628,797 A 2/1953 Campomar
2,745,421 A 5/1956 Russell
2,782,795 A 2/1957 Small
2,819,725 A 1/1958 Deisenroth et al.
2,888,689 A 6/1959 Mourot
D186,009 S 8/1959 Lorinez
D190,909 S 7/1961 Banyard
3,003,509 A 10/1961 Hibbard
3,129,715 A * 4/1964 Militano ..... A45B 17/00 135/20.3
3,156,249 A 11/1964 Biderman
3,171,418 A 3/1965 Meyer
3,177,882 A 4/1965 Militano
3,213,868 A 10/1965 Forbes
3,217,723 A 11/1965 Suchy
3,252,469 A 5/1966 Peake
3,311,119 A * 3/1967 Pearlstine ..... A45B 17/00 135/20.3
3,365,778 A 1/1968 Millerbernd
3,424,180 A 1/1969 Andolfi
3,486,514 A 12/1969 Prescott
3,742,532 A 7/1973 Bernstien
3,850,186 A 11/1974 Weber et al.
D239,666 S 4/1976 Medlin
4,000,750 A 1/1977 Becher
4,011,881 A 3/1977 Becher
4,022,233 A 5/1977 Grundman
4,086,931 A 5/1978 Hall
D254,849 S 4/1980 Matsuda
4,317,552 A 3/1982 Weidler
4,319,600 A 3/1982 Roche
D266,098 S 9/1982 Thorton
4,347,862 A 9/1982 Secon
4,368,749 A 1/1983 Lindler et al.
4,407,317 A 10/1983 Crandall
4,424,824 A * 1/1984 Becher ..... A45B 19/04 135/20.3
4,433,699 A 2/1984 Schultes et al.
D273,346 S 4/1984 Secon
4,567,907 A 2/1986 Dubinsky
4,649,678 A 3/1987 Lamson
4,747,422 A 5/1988 Chung
4,766,920 A 8/1988 Grady, II
4,807,655 A 2/1989 Robertson
4,832,304 A 5/1989 Morgulis
4,834,126 A 5/1989 Sweet, Jr.
4,903,926 A 2/1990 McNarry et al.
4,928,718 A 5/1990 Apple
4,934,394 A 6/1990 Hermanson
4,993,445 A 2/1991 Dubinsky
5,020,557 A 6/1991 Apple
D318,428 S 7/1991 Kowk
5,031,371 A 7/1991 Davister
5,051,285 A 9/1991 Borzakian
5,069,410 A 12/1991 McKee
5,122,014 A 6/1992 Genfan
D328,198 S 7/1992 Blackman
5,141,448 A 8/1992 Mattingly et al.
5,152,495 A 10/1992 Jacinto et al.
5,174,319 A 12/1992 Chou et al.
5,186,123 A 2/1993 Cuddy
5,193,566 A 3/1993 Chen
5,213,122 A 5/1993 Grady, II
5,213,123 A 5/1993 Whitfield
D336,744 S 6/1993 Kahn et al.
5,218,981 A 6/1993 Lai
5,224,505 A 7/1993 Wu
5,226,438 A 7/1993 Dubinsky
5,255,954 A 10/1993 Rogers
5,284,171 A 2/1994 Liu
5,291,908 A 3/1994 Grady, II
5,333,322 A 8/1994 Weir
5,337,989 A 8/1994 Apple
5,345,962 A 9/1994 Moss
D351,099 S 10/1994 Flasz
5,354,031 A 10/1994 Bilotti
5,355,903 A 10/1994 Haddad et al.
5,383,644 A 1/1995 Huse
5,386,842 A 2/1995 Becher
5,390,685 A 2/1995 McCoy
5,398,709 A 3/1995 Lee
5,410,937 A 5/1995 Okamoto et al.
5,433,233 A 7/1995 Shiran et al.
5,441,066 A 8/1995 Harris
5,444,946 A 8/1995 Zeigler
D364,141 S 11/1995 Hanna et al.
5,488,966 A 2/1996 Baldwin et al.
5,499,644 A 3/1996 Geniele
5,515,878 A 5/1996 Wu
5,525,000 A 6/1996 Belobraydich et al.
5,535,978 A 7/1996 Rodriguez et al.
D373,465 S 9/1996 Chipman
5,558,584 A 9/1996 Brown
5,564,453 A 10/1996 Steiner
5,571,229 A 11/1996 Fitzsimmons et al.
5,615,697 A 4/1997 Lin et al.
5,617,888 A 4/1997 Wu
5,636,649 A 6/1997 Horvath
5,640,984 A 6/1997 Dubunsky
5,655,557 A 8/1997 Martin
5,697,190 A 12/1997 Scribner
5,711,332 A 1/1998 Apple
5,715,853 A 2/1998 Lin
5,725,004 A 3/1998 Moulder
5,743,283 A 4/1998 Horvath
5,749,386 A 5/1998 Samuel, Jr.
5,752,349 A 5/1998 Fitzsimmons et al.
5,833,349 A 11/1998 Apple
5,836,328 A 11/1998 Lee
5,864,998 A 2/1999 Loomer
5,871,024 A 2/1999 Vanderminden, Sr.
5,876,011 A 3/1999 Blasing
5,884,645 A 3/1999 Chen et al.
5,884,859 A * 3/1999 Ma ..... A45B 25/14 135/20.3
5,909,746 A 6/1999 Doster et al.
5,911,493 A 6/1999 Walker et al.
5,913,778 A 6/1999 Hying et al.
5,918,849 A 7/1999 Bliss
5,979,119 A 11/1999 Trafton
D420,890 S 2/2000 Kuhnke
D421,708 S 3/2000 Kuhnke
6,041,559 A 3/2000 Schickert et al.
D422,784 S 4/2000 Au
6,058,952 A 5/2000 Lin et al.
6,076,540 A 6/2000 You
6,089,246 A 7/2000 Barnes
6,109,573 A 8/2000 Liao et al.
6,155,937 A 12/2000 Alter
6,173,721 B1 1/2001 Mery

(56) References Cited

U.S. PATENT DOCUMENTS

| | | | | |
|---|---|---|---|---|
| 6,182,917 | B1 * | 2/2001 | Lai | A45B 25/14 135/20.3 |
| 6,186,157 | B1 | 2/2001 | Lin et al. | |
| 6,196,241 | B1 | 3/2001 | Doolan | |
| 6,196,242 | B1 | 3/2001 | Xu | |
| 6,199,569 | B1 | 3/2001 | Gibson | |
| 6,202,369 | B1 | 3/2001 | Partee et al. | |
| 6,202,660 | B1 | 3/2001 | Steiner | |
| 6,209,147 | B1 | 4/2001 | Wheaton | |
| 6,213,672 | B1 | 4/2001 | Varga | |
| 6,230,728 | B1 | 5/2001 | Reese | |
| 6,230,746 | B1 | 5/2001 | Ions et al. | |
| 6,298,867 | B1 | 10/2001 | Chang | |
| 6,314,976 | B1 | 11/2001 | Clarke | |
| 6,325,084 | B1 | 12/2001 | Cohen | |
| 6,345,637 | B1 | 2/2002 | Ko | |
| 6,371,140 | B1 | 4/2002 | Atanda | |
| 6,374,840 | B1 | 4/2002 | Ma | |
| 6,386,214 | B1 | 5/2002 | Clarke | |
| D459,871 | S | 7/2002 | Persson | |
| D461,329 | S | 8/2002 | Liu | |
| 6,461,084 | B1 | 10/2002 | Stuart | |
| 6,474,244 | B1 | 11/2002 | Karpinski | |
| 6,484,452 | B2 | 11/2002 | Yen | |
| D467,066 | S | 12/2002 | You | |
| D470,305 | S | 2/2003 | Clarke | |
| 6,543,464 | B1 * | 4/2003 | Grady, II | A45B 25/14 135/20.3 |
| D475,524 | S | 6/2003 | Clarke | |
| 6,571,403 | B2 | 6/2003 | Wheaton | |
| 6,576,331 | B1 | 6/2003 | Ryan | |
| D477,575 | S | 7/2003 | Mayo et al. | |
| D478,416 | S | 8/2003 | Clarke | |
| 6,682,000 | B1 | 1/2004 | Apple | |
| 6,691,721 | B2 | 2/2004 | Apple | |
| 6,694,993 | B2 | 2/2004 | Chou | |
| 6,711,764 | B1 | 3/2004 | Mauze, Jr. | |
| 6,722,381 | B2 * | 4/2004 | Lai | A45B 25/14 135/20.3 |
| 6,725,870 | B1 | 4/2004 | Lo | |
| 6,729,076 | B1 | 5/2004 | Gale | |
| 6,732,753 | B2 * | 5/2004 | Chang | A45B 25/14 135/20.3 |
| D491,348 | S | 6/2004 | Clarke | |
| D491,720 | S | 6/2004 | Clarke | |
| 6,767,019 | B2 | 7/2004 | van Hekken | |
| 6,772,777 | B1 | 8/2004 | Mann | |
| D497,478 | S | 10/2004 | Clarke | |
| D497,479 | S | 10/2004 | Yu | |
| 6,802,325 | B1 | 10/2004 | Apple | |
| 6,805,143 | B2 | 10/2004 | Yen et al. | |
| 6,810,893 | B1 | 11/2004 | Nevin | |
| D502,800 | S | 3/2005 | Snyders | |
| 6,869,370 | B2 | 3/2005 | Davtyan et al. | |
| 6,881,153 | B2 | 4/2005 | Andrews | |
| 6,889,699 | B2 | 5/2005 | Clarke | |
| 6,926,019 | B2 | 8/2005 | Glatz | |
| D516,040 | S | 2/2006 | Moye | |
| D516,294 | S | 3/2006 | Olson et al. | |
| 7,040,593 | B1 | 5/2006 | Weatherall | |
| D522,605 | S | 6/2006 | Bishirjian | |
| 7,063,029 | B1 | 6/2006 | Tsui et al. | |
| 7,063,096 | B2 | 6/2006 | Stoeckler | |
| 7,152,258 | B2 | 12/2006 | Branch, III | |
| D538,758 | S | 3/2007 | Lemaire | |
| D546,775 | S | 7/2007 | Mayo et al. | |
| D548,500 | S | 8/2007 | Bailey | |
| 7,293,573 | B2 | 11/2007 | Clarke | |
| 7,302,745 | B2 | 12/2007 | Stahle | |
| D559,528 | S | 1/2008 | Clarke | |
| 7,318,444 | B2 | 1/2008 | Clarke | |
| 7,353,583 | B1 | 4/2008 | Clarke | |
| 7,392,816 | B2 | 7/2008 | Porter et al. | |
| 7,406,976 | B1 * | 8/2008 | Chan | A45B 25/14 135/16 |
| 7,481,232 | B2 * | 1/2009 | Apple | A45B 23/00 135/16 |
| 7,562,666 | B2 | 7/2009 | Chan | |
| 7,600,734 | B2 | 10/2009 | Clarke | |
| 7,665,477 | B1 | 2/2010 | Hathaway | |
| D612,146 | S | 3/2010 | Clarke | |
| D625,933 | S | 10/2010 | Grunewald | |
| 7,963,293 | B2 | 6/2011 | Ma | |
| 8,096,310 | B2 | 1/2012 | Clarke | |
| 8,534,304 | B1 * | 9/2013 | Tung | A45B 17/00 135/16 |
| 2001/0054433 | A1 | 12/2001 | Patarra | |
| 2002/0072423 | A1 | 6/2002 | Pot | |
| 2002/0079398 | A1 * | 6/2002 | Liu | A45B 25/14 242/395 |
| 2003/0005952 | A1 | 1/2003 | Chen | |
| 2003/0168090 | A1 | 9/2003 | Apple | |
| 2003/0205021 | A1 | 11/2003 | Ryan | |
| 2004/0035452 | A1 | 2/2004 | Ma | |
| 2004/0098802 | A1 | 5/2004 | Lee | |
| 2004/0134529 | A1 | 7/2004 | Stoeckler | |
| 2004/0206383 | A1 | 10/2004 | Clarke | |
| 2005/0045219 | A1 | 3/2005 | Apple | |
| 2005/0126612 | A1 | 6/2005 | Chen | |
| 2005/0268953 | A1 | 12/2005 | Ma | |
| 2006/0054285 | A1 | 3/2006 | Louis | |
| 2011/0057077 | A1 | 3/2011 | Johnson | |
| 2011/0192434 | A1 | 8/2011 | Young et al. | |
| 2013/0092200 | A1 | 4/2013 | May | |

FOREIGN PATENT DOCUMENTS

| | | |
|---|---|---|
| DE | 19721037 C1 | 2/1999 |
| EP | 0628264 | 12/1994 |
| EP | 0897678 | 2/1999 |
| EP | 1510145 | 3/2005 |
| EP | 1202647 | 10/2007 |
| EP | 1988795 | 6/2011 |
| FR | 2844430 | 3/2004 |
| GB | 1809 | 0/1905 |
| GB | 2165448 | 4/1986 |
| JP | 2002142824 | 5/2002 |
| MX | 295823 | 2/2012 |
| WO | WO 2007092514 | 8/2007 |
| ZA | 200110164 | 12/2002 |

* cited by examiner

CRANK HANDLE POSITIONING ASSEMBLY FOR AN UMBRELLA

CLAIM OF PRIORITY

The present application is based on and a claim of priority is made under 35 U.S.C. Section 119(e) to a provisional patent application that is in the U.S. Patent and Trademark Office, namely, that having Ser. No. 61/992,557 and a filing date of May 13, 2014, and which is incorporated herein by reference.

BACKGROUND OF THE INVENTION

Field of the Invention

This invention is directed to a crank handle positioning assembly for disposing a canopy assembly of an umbrella between open and closed orientations. A gear housing disposed within the interior of a mast of the umbrella encloses a gear assembly also within the interior of the umbrella mast, thereby eliminating any bulky housing or casing being disposed on the exterior of the mast.

Description of the Related Art

Comparatively large outdoor umbrellas are employed to shield people from the sun, wind, rain and other elements of nature. As such, they are intentionally designed and structured to withstand such natural elements when the canopy assembly, associated with the umbrella, is disposed in both an expanded, open orientation and a collapsed, closed orientation. Accordingly, structural and operative features associated with known outdoor umbrellas typically include a number of different components which are operative to selectively dispose a flexible and/or foldable material canopy portion of the canopy assembly in either of the open or closed orientations. To facilitate the preferred orientation of the canopy, the canopy assembly may include a plurality of ribs and interconnecting struts which are disposed in supporting relation to the canopy. Further, the plurality of struts and corresponding ones of the plurality of ribs may be pivotally or otherwise movably connected to one another to facilitate an effective and efficient positioning of the canopy between the aforementioned open and closed orientations.

Dependent on dimensional and structural characteristics of the outdoor umbrella, a variety of different structural components are utilized to allow easy and efficient positioning of the canopy assembly, as desired. For example, some canopy assemblies may be driven by a spring-loaded or fluid powered assembly which serves to "automatically" dispose the canopy between the aforementioned open and closed orientations. However, in less complex designs the canopy assembly and other cooperative portions of a given umbrella may be operated manually to accomplish a disposition of the canopy assembly between the closed and open orientations. Typically, this may be accomplished by a manual or mechanical positioning of a central hub disposed in slighting relation along the exterior of the mast or center post of the umbrella. More specifically, a main hub member may be movably secured about the mast or center post and be specifically structured for sliding movement along the length of the mast. Additional structural features associated with such a central hub component may be its ability to rotate coaxially about the length of the mast thereby allowing different positions or angular orientations of the canopy to be assumed.

Yet another generally known structure associated with the positioning of the canopy assembly between the open and closed orientations comprises a manually powered, rotatable crank handle. As conventionally used and known, such crank handles are connected to a casing, housing, or like structure which is entirely mounted on or connected to an exterior of the mast or center post of the umbrella. This exterior location presents numerous problems or disadvantages related to the overall aesthetic appearance of the umbrella as well as the operational and performance characteristics thereof. Due to the fact that the exteriorly mounted casing is frequently disposed in an unfavorable location, an unintended contact or engagement with surrounding objects and individuals may result in possible damage to the casing and the crank handle itself or the individuals or objects coming in contact there with.

Therefore, there is a need in the field of art relating to umbrellas and in particular, relatively large outdoor umbrellas, for an improved positioning assembly, preferably in the form of a crank handle positioning assembly, which is efficiently operable also capable of being disposed and dimensioned so as to be non-obtrusive and in an out of the way location. If any such improved positioning assembly were developed, it would preferably also be dimensioned and configured to have its major, operative components disposed within the interior portions of an at least partially hollow mast or post of the umbrella. Further, if any such improved positioning assembly were developed, it could still be operable using a manually rotatable crank handle accessible by its positioning, whether fixed or removable, on an exterior of the mast or post of the umbrella. Moreover, if any such improved positioning assembly were developed, it would ideally be further structured to extend through the mast into rotationally driving connection with a gear assembly and gear housing. As a result, a majority or significant number of the operative components associated with the improved and proposed crank handle positioning assembly could also be disposed within the interior of the hollow mast or center post. Further, if any such improved positioning assembly were developed, such operative components could then be drivingly interconnected to a central hub movable along the length of the mast and/or to the components of the canopy assembly, including the struts, ribs, etc. to facilitate the selective orientation thereof in either the open or closed orientations, as desired. In short, if it were possible to develop an improved positioning assembly that is removed from an exterior mounting or connected location on the mast or center post, it would overcome many of the disadvantages and problems recognized in the use of conventional crank handles with large, outdoor umbrella structures.

SUMMARY OF THE INVENTION

The present invention is intended to address these and other needs which remain in this field of art, and as such, is directed to an improved positioning assembly of the type structured to selectively position the canopy assembly of an umbrella between an open orientation and a closed orientation. While the versatility of the positioning assembly of the present invention facilitates the use thereof with a variety of differently structured outdoor umbrellas, one or more preferred embodiments of the present invention incorporates the use of the positioning assembly with a relatively large, outdoor umbrella of the type including a flexible material canopy.

In addition, a plurality of supporting ribs and interconnecting struts define additional portions of the canopy assembly of the umbrella, wherein the struts and ribs are pivotally or otherwise movably connected to one another to facilitate the support and movement of the flexible material canopy between the aforementioned open, expanded orientation and the closed, compacted orientation. Further, one or more umbrellas with which the positioning assembly of the present invention may be used may also include a central hub movably connected to an exterior of a mast, stanchion, center post or like primary support of the canopy assembly. As such, the plurality of struts are pivotally or movably connected to the central hub at their inner or proximal ends and are movably or pivotally connected to individual ones of a plurality of ribs at the outer end thereof. As result, movement of the hub along the length of the mast or center post will result in the canopy assembly being disposed between the open and closed orientations.

As indicated above, one or more disadvantages or problems associated with conventional or commonly used crank handles is the mounting thereof on the exterior of the umbrella's mast, pole, or center post along with a casing, housing or like structure which may enclose the working parts of the overall crank assembly. Accordingly, one or more preferred embodiments of the crank handle positioning assembly of the present invention is structured to selectively position a mast mounted canopy assembly of an umbrella between open and closed orientations by incorporating the majority of the operative components thereof within the interior of the hollow mast used to support the canopy assembly.

More specifically, the crank handle positioning assembly of the present invention includes a gear housing disposed within the interior the mast in at least partially enclosing relation to a gear assembly. In addition, an elongated drive gear, such as a worm gear or screw gear is also disposed within the hollow interior of the mast and extends along a predetermined length thereof dependent, at least in part, on the overall size and operative features of the umbrella with which it is used.

Further, a crank handle may be permanently or removably connected in rotationally driving relation to the enclosed gear assembly. As such, it is a drive shaft or drive link associated with the crank handle may pass through an exterior portion of the mast and through at least one access opening formed in the gear housing. Once disposed in this operative position, manual rotation of the crank handle will result in an operative, driving rotation of the gear assembly. Similarly, forced driven rotation of the gear assembly within the gear housing will force a driving rotation of the elongated drive gear disposed within and extending along a length of the interior of the mast. Moreover, a proximal end of the drive gear is connected in driven relation to the gear assembly enclosed within the gear housing. An opposite or distal end of the elongated drive gear is rotationally connected to an anchor, support mount, end cap, etc. which itself is disposed within the interior of the mast at a location spaced from the gear housing, such as towards the upper end of the mast. Further, the anchor or and/or support mount may serve to further secure the drive gear within the interior of the mast.

Yet additional operative and structural features of the crank handle positioning assembly include at least one rider movably connected to the elongated drive gear. More specifically, forced, driven rotation of the drive gear will result in a linear travel of the one rider along the length thereof. Further, depending on the direction of rotation of the drive gear the rider member will move in opposite directions along the length thereof. Moreover, in at least one preferred embodiment the rider is connected to the aforementioned central hub movable along the exterior of the mast by means of one or more cords, wires, etc. As a result, linear movement of the rider member along a corresponding length of the elongated drive gear will in turn force the exterior central hub to move along the length of the mast. As also indicated above, a plurality of struts of the canopy assembly may be movably or pivotally connected to the external, central hub at one end and movably or pivotally connected to individual ones of the plurality of ribs after outer end. Therefore, the forced, driven movement of the central hub along the exterior of the mast will in turn cause intended movement of the struts and corresponding ones of the ribs. As a result and dependent on the direction of linear movement of the rider member along the drive gear, the canopy assembly will be forced into and between the open orientation and the closed orientation.

As also indicated, manual rotation of the crank handle, once inserted into its operative position in driving connection or engagement with the gear assembly enclosed within the gear housing, will result in a forced rotation of the gear assembly and a resulting driving, forced rotation of the elongated drive gear. Therefore, dependent on the direction of rotation of the crank handle, the aforementioned rider member will be forced either upwardly or downwardly along the length of the elongated drive gear. In turn, the exterior, central hub will be forced along the length of the mast causing the movably connected struts to force the corresponding ribs of the canopy assembly to assume either the aforementioned open, expanded orientation or a closed, collapsed orientation.

Of further note is the different structuring of the umbrellas with which the crank handle positioning assembly of the present invention may be used. By way of example, and as described in greater detail hereinafter, a rotation of the crank handle in a direction which accomplishes an opening or expansion of the canopy assembly, may be a result of the rider moving in a direction along the length of the drive gear, such that the exterior central hub is raised towards the upper end of the mast. However, when it is desired to position the canopy assembly in a closed or collapsed orientation, rotation of the crank handle in the opposite direction serves to effectively "release" a driving pressure or force from the exterior central hub. As a result, the overall weight of the canopy assembly may be sufficient to allow a closure of the canopy assembly, concurrent to the central hub being allowed to travel along the mast to a lower position than the hub assumed when in a fully opened orientation. Moreover, when in an open orientation, the frictional engagement between the rider and the exterior surface of the elongated drive gear will generally be sufficient to maintain the canopy assembly in the preferred, open orientation. The rotation of the crank handle in an opposite direction, which allows the rider to travel in an opposite direction on the elongated drive gear, will in turn allow the external hub to move to a lower point on the exterior of the mast, thereby reducing any frictional engagement between the rider and the drive gear, which would maintain the canopy assembly in an open orientation or partially open orientation.

Yet additional structural and operative features of one or more preferred embodiments of the crank handle positioning assembly of the present invention includes a gear assembly. More specifically, the gear assembly is enclosed within a gear housing and a hollow portion of the mast, and comprises a first pair of bevel gears and a second pair of bevel gears disposed in intermeshing engagement with one another. Moreover, the crank handle, once in its operative position, is disposed in driving engagement with at least one of the bevel gears of the first pair of bevel gears. However, structural modifications of the gear housing as well as the gear assembly facilitate the possible and/or selective positioning of the crank handle into driving engagement with either of the bevel gears of the first pair of bevel gears. In cooperation therewith, the gear housing may include a plurality of at least two access openings through which the drive link or driveshaft of the crank handle may be rotationally positioned so as to drivingly engage either of the first pair of bevel gears. In addition, at least one of the bevel gears of the second pair of bevel gears is disposed in rotationally driving connection with the at least one elongated drive gear. Therefore, forced rotation of the either one of the second pair of bevel gears, through rotation of the crank handle, will result in a forced rotation of the second pair of bevel gears and a resultant forced rotation of the one, elongated drive gear. As set forth above, the rotation of the drive gear will result in a linear movement of the rider along the length thereof, and the corresponding opening or closing of the canopy assembly.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
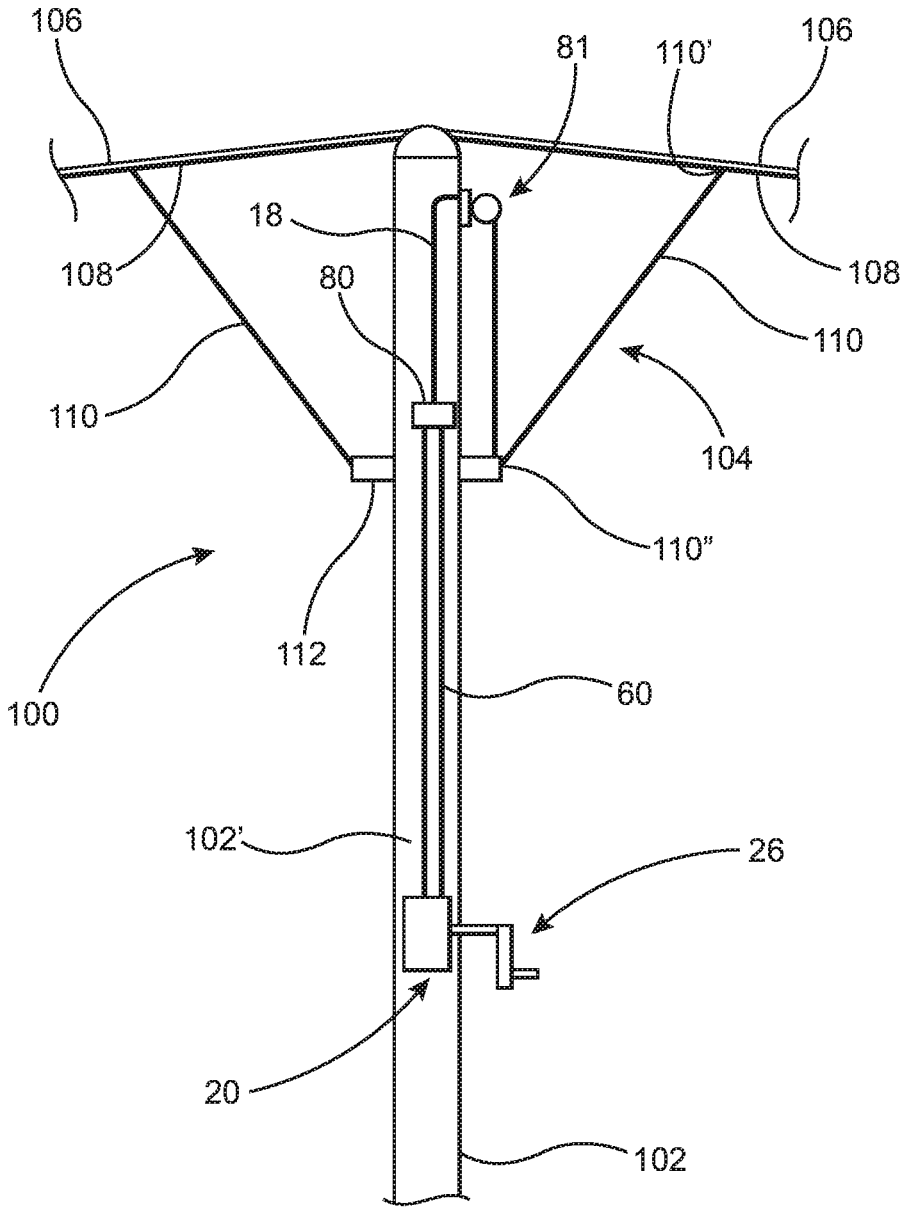
FIG. 1 is a schematic representation of an umbrella with the crank handle positioning assembly of the present invention operatively connected thereto.

As represented in the accompanying Figures, the present invention is directed to a crank handle positioning assembly of the type to be used with an umbrella, such as but not limited to, a comparatively large outdoor umbrella. The versatility of the structural and operative features of the various preferred embodiments of the present invention facilitate its use with umbrellas of different structures, designs, dimensions and configurations.

However, and for purposes of illustration, the crank handle positioning assembly of the present invention will be described as being used in combination with an umbrella 100 of the type schematically represented in FIG. 1. As such, the umbrella 100 comprises a central mast, stanchion and/or center post 102, having an at least partially hollow interior 102'. The mast 102 is disposed in supporting relation to a canopy assembly generally represented as 104. Further, the canopy assembly 104 includes a flexible or foldable material canopy 106 being supported by a plurality of ribs 108. In addition to, the canopy assembly 104 also includes a plurality of struts 110 each of which have an outermost or distal end 110' movably connected to a different one of the plurality of ribs 108. Also, each of the struts 110 may have a proximal end 110" movably connected to a central hub 112. The hub 112 is movably connected to the exterior of the mast 102 and is reciprocally movable along the length thereof. Therefore, forced or selective movement of the central hub member 112 along the length of the exterior surface of the mast 102 will result in a relative movement of the plurality of struts 110 and corresponding ones of the plurality of ribs 108 such that the canopy 106 is selectively disposed between open and closed orientations, as will be explained in greater detail hereinafter. An additional feature of the one or more preferred embodiments of the crank handle positioning assembly of the present invention is it being used with an at least partially hollow and/or open interior 102' of the mast or center post 102.

Figure 2:
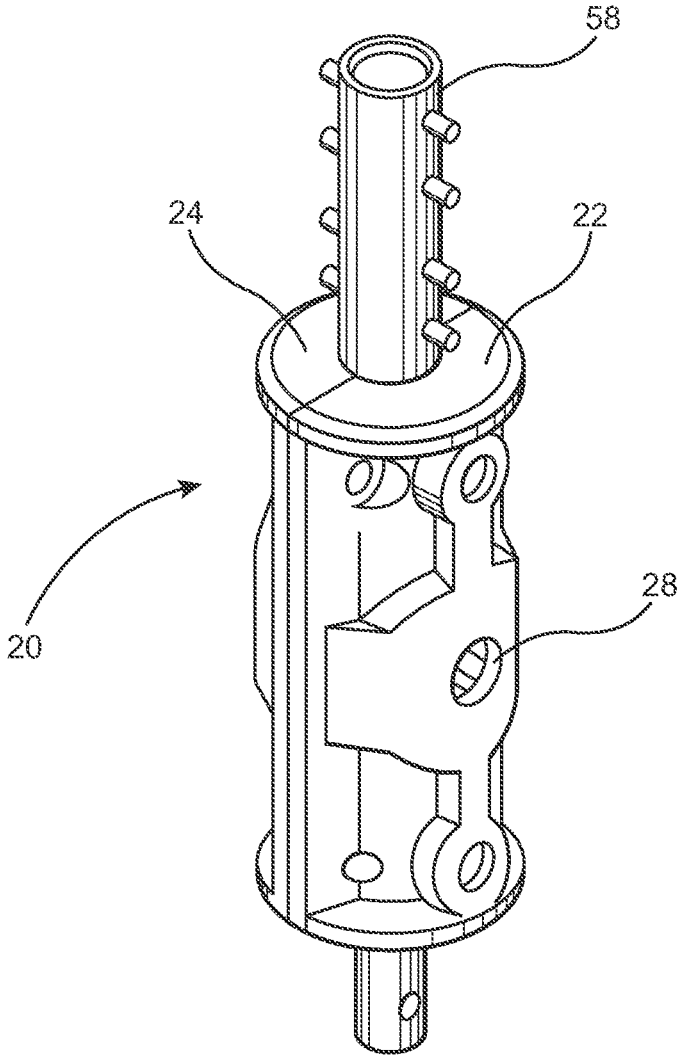
FIG. 2 is a perspective view in assembled form of a gear housing of the present invention.
Figure 3A:
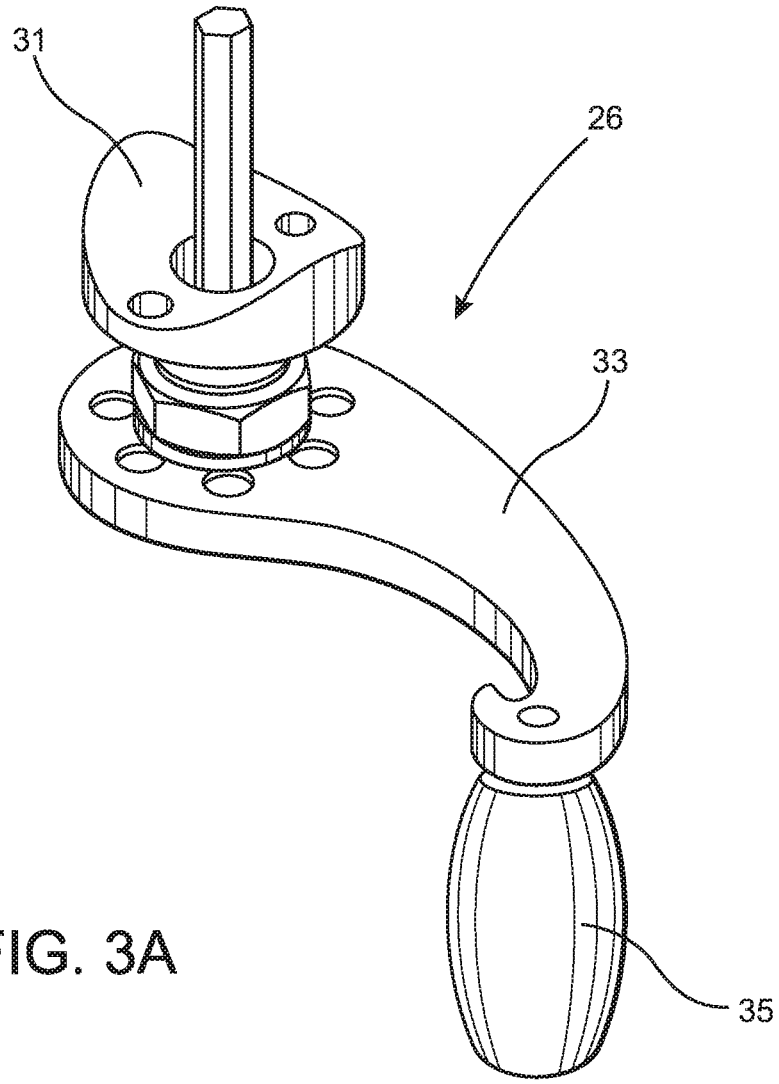
FIG. 3A is a rear perspective view of a crank handle operatively associated with the gear housing of the embodiment of FIG. 2.
Figure 3B:
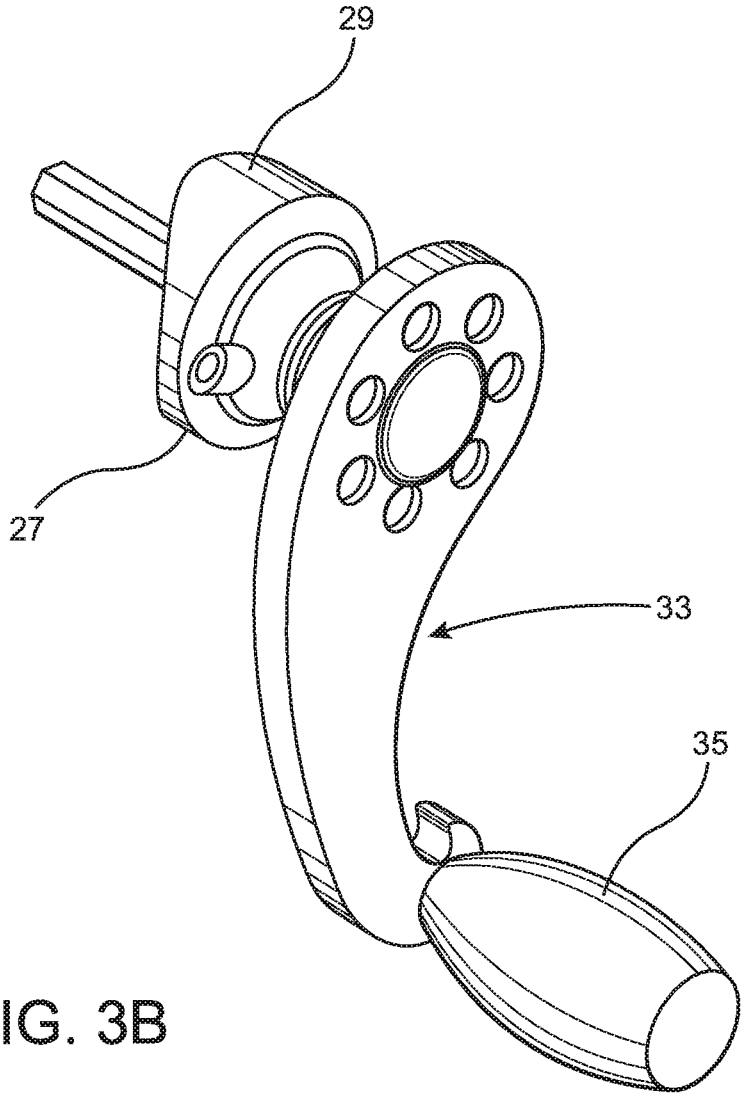
FIG. 3B is a front perspective view of the embodiment of FIG. 3A.
Figure 4:
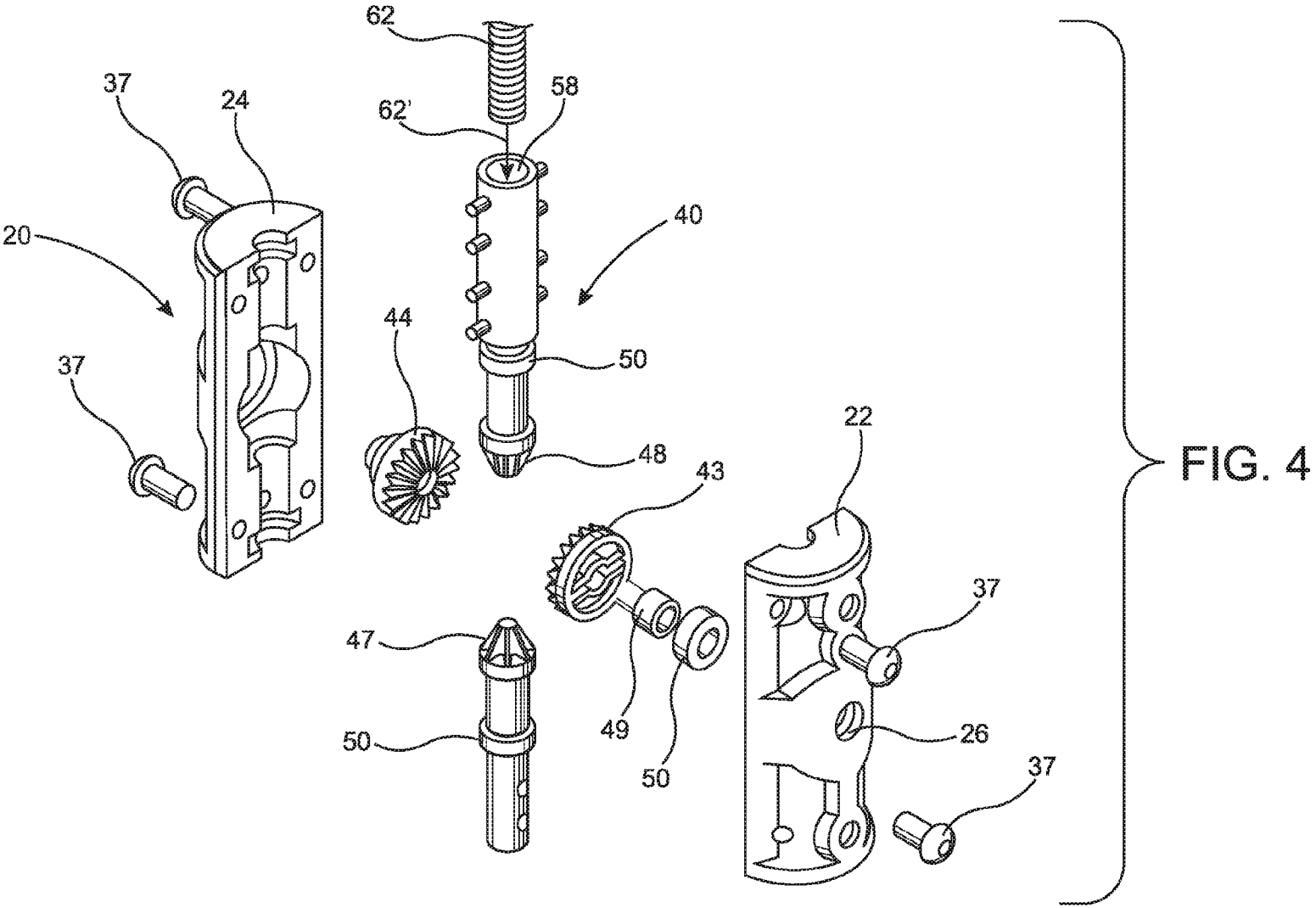
FIG. 4 is a perspective, exploded view of the gear housing of the embodiment of FIG. 2 and one embodiment of a gear assembly enclosed within the gear housing.

More specifically, and with primary reference to FIGS. 2-4, at least one preferred embodiment of the present invention includes a gear housing generally indicated as 20, including a plurality of at least two housing segments 22 and 24. The gear housing 20 is dimensioned and configured to fit within a hollow interior portion of the mast as generally and schematically represented in FIG. 1. In operation and use, a crank handle generally indicated as 26 is fixedly or removably connected to the gear housing 20 such as by extending through at least one access opening 28. However, in contrast to the gear housing 20, the crank handle 26 is mounted exteriorly of the mast in alignment and or operative connection with the gear housing 20 and through at least one access opening 28.

Accordingly, the crank handle 26 includes a drive shaft or drive link 27 having a support connector 29 secured thereto. The support connector 29 is intended to facilitate operative positioning and mounting of the crank handle 26 on the exterior surface of the mast. As such, an interior surface portion as at 31 of the crank handle 26 may have a correspondingly or cooperatively curved configuration, such as being at least partially concave so as to effectively make with the outer, cylindrical surface of the mast. The remainder of the crank handle 26 includes a base portion 33 and a knob or like gripping member 35 the connecting shaft or connecting link 27 is fixedly or connected to the base 33 such that manual rotation of the crank handle, such as by gripping of the knob member 35, will result in a rotation or turning of the drive shaft or drive link 27 and a forced rotation and driving of a gear assembly generally indicated as 40 and as explained in greater detail hereinafter.

With primary reference to FIG. 4, the gear assembly 40 is disposed and/or at least partially enclosed within the interior of the gear housing 20 when the gear housing segments 22 and 24 are connected to one another in the manner represented in FIG. 2. Such interconnection or attachment of the gear housing segments 22 and 24 is accomplished by one or more connectors 37 such as screws or the like. In the at least one preferred embodiment represented in FIG. 4, the gear assembly 40 includes a first pair of bevel gears 43 and 44 which may be disposed in facing, opposing relation to one another. In addition, gear assembly 40 includes a second pair of bevel gears 47 and 48. The bevel gears 47 and 48 of the second pair of bevel gears are also disposed in facing, opposing relation to one another as represented. Appropriate, cooperative components may also be included within the gear assembly 40 such as a driveshaft member 49, through which the drive shaft or drive link 27 of the crank handle 26 may pass, as well as appropriate bearing assemblies as at 50. Therefore, as should be apparent, the disposition of the gear housing 20 within the hollow interior of the mast also results in the placement and maintenance of the gear assembly 40, being enclosed by the gear housing 20, within the interior of the mast in an out-of-the-way, unobtrusive location.

In use, when the gear housing 20 and the gear assembly 40 are assembled and operatively disposed within the interior of the mast, the crank handle 26 is disposed in connecting, rotationally driving relation to the gear assembly 40. This is accomplished by inserting an outermost end of the drive shaft or drive link 27 of the crank handle 26 through the aforementioned access opening 28, and into driving engagement with at least one of the gears 43 of the first pair of bevel gears. When so positioned, the crank handle 26 and more specifically, the drive link or driveshaft 27 will be disposed in driving engagement with the at least one bevel gear 43. As a result, rotation of the crank handle 26 will result in a forced, driving rotation of the gear assembly 40. As should also be apparent, the first pair of bevel gears 43 and 44 is disposed in intermeshing engagement with the second pair of bevel gears 47 and 48. Accordingly, the rotation of the crank handle 26 will result in the at least one bevel gear 43 concurrently driving both the second bevel gears 47 and 48.

With primary reference to FIGS. 1, 4 and 5-5B, one or more preferred embodiments of the present invention also include at least one elongated drive gear generally indicated as 60. The drive gear 60 may be in the form of a worm gear or screw gear having one end 62 connected in driven relation to the gear assembly 40 and more specifically to the at least one bevel gear of the second bevel gear pair 47 and 48. Such interconnection may be by way of an adapter coupling 58 connected to or at least partially enclosing a corresponding end 62 of the elongated drive gear 60, as schematically represented by directional arrow 62' in the exploded view of FIG. 4. Accordingly, it should be apparent that a forced rotation of the crank handle 26 will result in a driving, rotation of the gear assembly 40 and the resultant driving rotation of the at least one elongated drive gear 60 by virtue of the interconnection of the drive gear 60 to the gear assembly 40 by adapter coupling 58.

Also, it should be apparent that the length of the at least one elongated drive gear 60 may vary and be increased or decreased based on the length or size of the mast and the overall size, dimension and configuration of the umbrella, with which the present invention is used.

Figure 5:
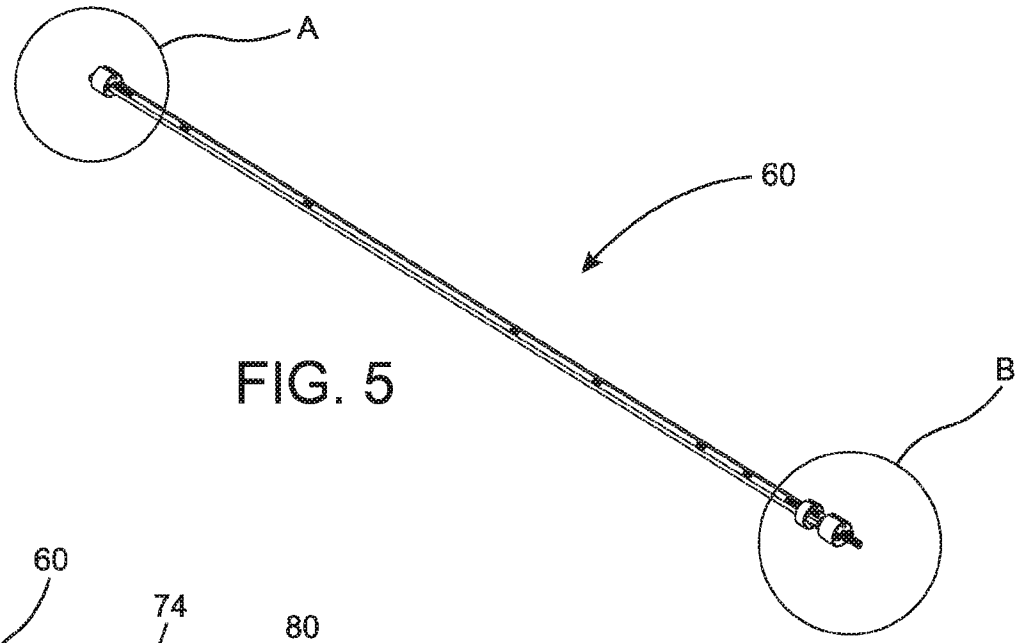
FIG. 5 is a perspective view of one preferred embodiment of an elongated drive gear including operative components connected thereto.
Figure 5B:
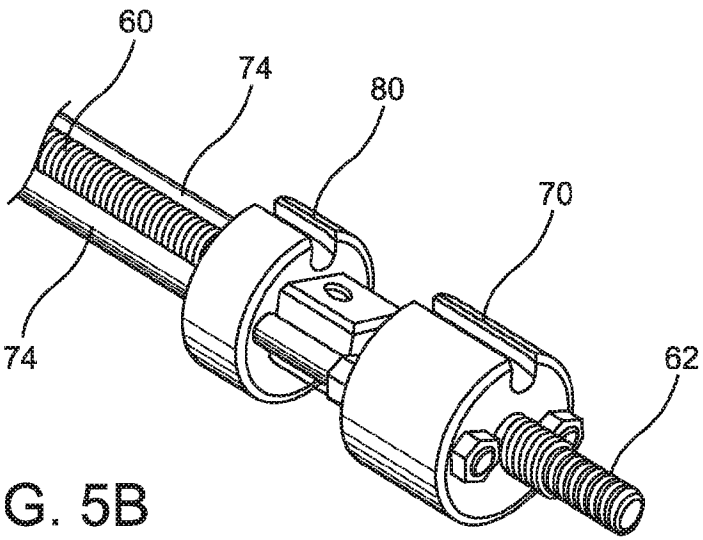
FIGS. 5A and 5B are detailed views in partial cutaway of designated portions of the embodiment of FIG. 7.
Figure 5A:
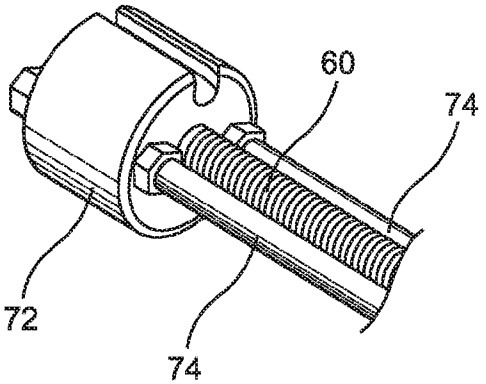
Figure 6B:
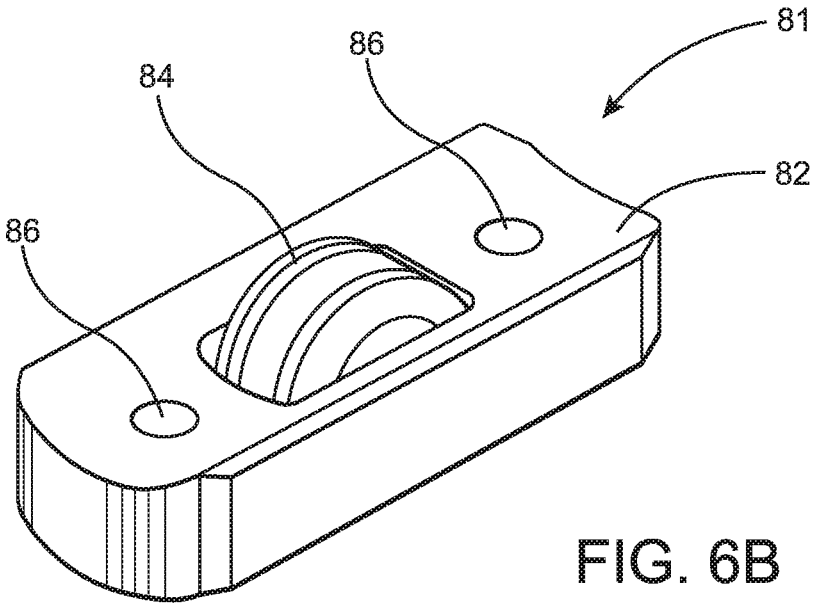
FIG. 6B is a rear perspective view of the embodiment of FIG. 6A.
Figure 6A:
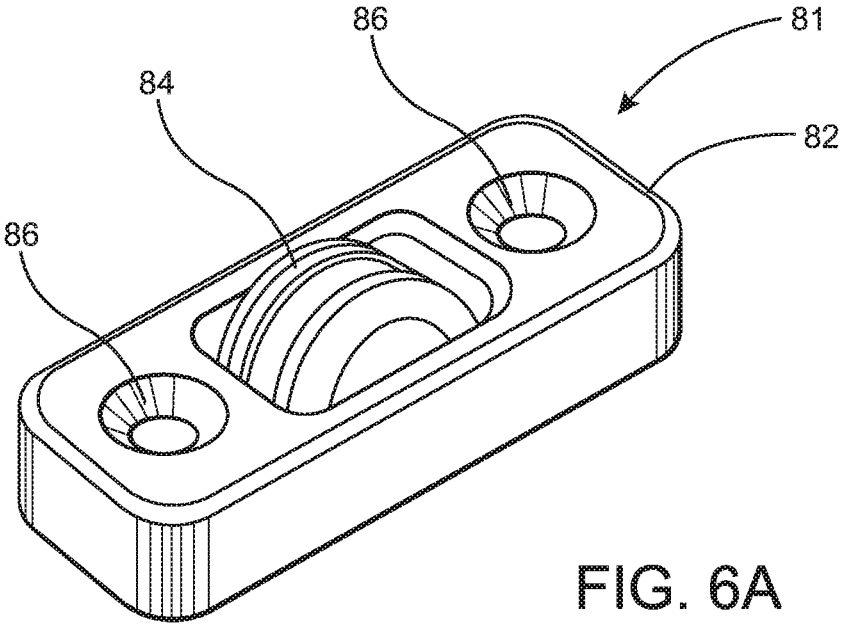
FIG. 6A is a front perspective view of a pulley structure associated with the present invention.

Therefore, one embodiment of the elongated drive gear is represented as 60 in FIGS. 5, 5A and 5B and includes an elongated externally threaded surface. In addition, a bottom cap member 70 and a top cap member 72 are secured to opposite ends of the drive gear 60. Also, in order to facilitate the selective disposition of the canopy assembly between the aforementioned open and closed orientations, one or more embodiments of the present invention include a rider member 80 disposed in driven, mating connection to the exterior threaded surface of the elongated drive gear 60. More specifically, an interior surface or other structural portions of the rider 80 may include a threaded surface or the substantially equivalent structure (not shown) disposed in meshing engagement with the externally threaded surface of the corresponding drive gear 60. Therefore, upon a forced rotation of the drive gear 60, the rider 80 will be forced to move or travel linearly along the length of the drive gear 60. Further, the linear direction of travel of the rider 80 will depend upon the rotational direction of the crank handle 26 when connected in driving relation to the drive assembly 40, as explained in detail above. Yet additional features represented in FIGS. 5A and 5B include positioning, mounting or stabilizing rods 74 disposed on opposite sides of the elongated drive gear 60 and connected to or extending at least partially through the rider 80. The rods 74 provides stability and facilitate linear, reciprocal travel of the rider 80 along the length of the drive gear 60 as the drive gear 60 rotates.

As also represented in FIG. 1, the rider 80 is connected by an appropriate cord, wire, etc. 18 to the central hub. As also explained herein the central hub is movably connected to the plurality of struts and plurality of ribs of the canopy assembly. Therefore forced movement of the rider 80 due to a rotation of the drive gear 60 and a concurrent rotation of the crank handle 26 in the proper direction will result in a positioning of the canopy assembly in an open orientation. While the canopy assembly is being opened, the central hub member will move upwardly along the length of the exterior of the mast. In contrast, rotation of the crank handle 26 in an opposite direction will result in the rider 80 traveling along the length of the drive gear 60 in a direction which will allow the exterior hub to move downwardly along the exterior surface of the mast. As also indicated, the movement of the canopy assembly into a closed orientation may be due at least in part to the weight of the canopy assembly and the influence of gravity thereon. However, movement of the rider 80 in the appropriate direction will reduce any frictional resistance which may normally occur between the interior surface of the rider 80 and the exterior threaded surface of the drive gear 60. However, when the canopy assembly is intended to be maintained in the open orientation frictional resistance between the rider 80 and the exterior surface of the drive gear 60 will facilitate a maintenance of the canopy assembly in the open orientation.

Therefore, dependent upon the direction of rotation of the crank handle 26. reciprocal, linear movement of the rider 80 along the exterior surface of the drive gear 60 and a concurrent linear movement of the central hub along the exterior surface of the mast will result in a relative movement of the struts and ribs of the canopy assembly and in turn result in an the disposition of the canopy and the remainder of the canopy assembly into and between the open and closed orientations. As represented in 6A and 6B interconnection of the aforementioned cord or wire 18 between the rider 80 and the central hub member will be facilitated by the cord or wire 18 passing through and along a pulley structure generally indicated as 81 including a pulley base 82 and a pulley member 84 rotationally mounted on the base 82. Appropriate apertures or connecting structure, as at 86, may be included in the base 82 to facilitate mounting or attachment of the pulley assembly 81 to the mast or other appropriate portion which facilitates guidance of the cord or wire 18 between the rider 80 and the hub member.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly structured to position a mast mounted canopy assembly of an umbrella between open and closed orientations, said assembly comprising:

a gear housing disposed within an interior of the mast;

a gear assembly at least partially disposed within said gear housing on the interior of the mast, at least one elongated drive gear rotationally connected in driven relation to said gear assembly, a crank handle disposed exteriorly of the mast and extending at least partially there through into a driving connection with said gear assembly, at least one rider member connected in driving relation to the canopy assembly and in driven in engagement with said one drive gear, at least one cord connected to said rider member, and interconnecting said rider member to the canopy assembly, said at least one cord disposed in spaced relation relative to said drive gear, said one rider member linearly movable in opposite directions along the length of said one drive gear dependent on a direction of rotation of said crank handle relative to said gear assembly, said at least one cord linearly movable in opposite directions along the length of said one drive gear dependent on a direction of movement of said rider member, said at least one cord also being linearly movable in opposite directions independent of engagement and in non-winding relation with said drive gear, and concurrent, cooperative directions of linear movement of said rider member and said at least one cord and rotational movement of said crank handle being determinative of the positioning of the canopy assembly in the open orientation or the closed orientation.

2. The assembly as recited in claim 1 wherein said gear housing includes at least two housing segments connected to one another within the interior of the mast in at least partially enclosing relation to said gear assembly.

3. The assembly as recited in claim 2 wherein at least one of said housing segments includes an access opening disposed and dimensioned to movably receive a portion of said crank handle there through in driving connection with said gear assembly.

4. The assembly as recited in claim 3 wherein said crank handle comprises a driveshaft disposed through said access opening into rotationally driving connection with said gear assembly.

5. The assembly as recited in claim 4 further comprising a support mounted on said driveshaft and including a convex surface having a predetermined configuration facilitating fixed mounting engagement of said support with an exterior surface of the mast.

6. The assembly as recited in claim 5 wherein said predetermined configuration comprises a substantially concave configuration.

7. The assembly as recited in claim 1 wherein said gear assembly comprises a first pair of bevel gears, at least one of said first pair of bevel gears interconnected in rotationally driven relation to said crank handle.

8. The assembly as recited in claim 7 wherein said gear assembly comprises a second pair of bevel gears each connected in intermeshing, driven relation with said one bevel gear of said first pair of bevel gears.

9. The assembly as recited in claim 8 wherein said each of said first pair of bevel gears is disposed in opposing relation to one another and in intermeshing engagement with each of said second pair of bevel gears.

10. The assembly as recited in claim 9 wherein said bevel gears of said second pair of bevel gears are disposed in opposing relation to one another.

11. The assembly as recited in claim 8 wherein at least one of said second pair of bevel gears is connected in driving relation to said one drive gear.

12. The assembly as recited in claim 7 wherein either of said first pair of bevel gears is connected to and rotationally driven by said crank handle.

13. The assembly as recited in claim 12 wherein said gear housing includes at least two housing segments connected to one another in at least partially enclosing relation to said gear assembly.

14. The assembly as recited in claim 13 wherein each of said two housing segments includes an access opening disposed and dimensioned to rotationally receive a portion of said crank handle there through in driving connection with a different one of said first pair of bevel gears.

15. The assembly as recited in claim 1 wherein said one drive gear comprises a worm gear including a proximal end interconnected in driven relation to said gear assembly.

16. The assembly as recited in claim 15 further comprising an anchor member rotationally connected to a distal end of said one drive gear, said anchor member interconnecting said distal end within a corresponding interior portion of the mast.

17. An assembly structured to position a mast mounted canopy assembly of an umbrella between open and closed orientations, said assembly comprising:

a gear housing disposed within an interior of the mast;

a gear assembly at least partially disposed within said gear housing on the interior of the mast, at least one elongated drive gear disposed within the mast and connected in rotationally driven relation to said gear assembly, a crank handle disposed exteriorly of the mast and extending at least partially through the mast and said gear housing into a rotationally driving connection with said gear assembly, a rider member connected in driving relation to the canopy assembly; said rider member mounted on an exterior surface of said one drive gear in driven in engagement there with, at least one cord connected to said rider member, and interconnecting said rider member to the canopy assembly, said one cord disposed in spaced relation relative to said drive gear, said one rider member linearly movable in opposite directions along the length of said one drive gear, dependent on a direction of rotation of said drive gear and crank handle relative to said gear assembly, said at least one cord linearly movable in opposite directions along the length of said one drive gear dependent on a direction of movement of said rider member, said at least one cord also being linearly movable in opposite directions independent of engagement and in non-winding relation with said one drive gear, and concurrent, cooperative directions of linear movement of said rider member and said at least one cord and rotational movement of said drive gear and said crank handle being determinative of the positioning of the canopy assembly in the open orientation or the closed orientation.

18. The assembly as recited in claim 17 wherein said gear housing includes at least two housing segments connected to one another within the interior of the mast in at least partially enclosing relation to said gear assembly.

19. The assembly as recited in claim 17 wherein said gear assembly comprises a first pair of bevel gears, at least one of said first pair of bevel gears interconnected in rotationally driven relation to said crank handle.

20. The assembly as recited in claim 19 wherein said gear assembly comprises a second pair of bevel gears each connected in intermeshing, driven relation with said one bevel gear of said first pair of bevel gears.

21. The assembly as recited in claim 20 wherein said each of said first pair of bevel gears is disposed in opposing relation to one another and in intermeshing engagement with each of said second pair of bevel gears.

22. The assembly as recited in claim 21 wherein said bevel gears of said second pair of bevel gears are disposed in opposing relation to one another.

23. The assembly as recited in claim 20 wherein at least one of said second pair of bevel gears is connected in driving relation to said one drive gear.

24. An assembly structured to position a mast mounted canopy assembly of an umbrella between open and closed orientations, said assembly comprising:

a gear housing disposed within an interior of the mast;

a gear assembly at least partially disposed within said gear housing on the interior of the mast, at least one elongated drive gear disposed within the mast and connected in rotationally driven relation to said gear assembly, a crank handle comprising a driveshaft, said crank handle disposed exteriorly of the mast and extending at least partially through the mast and said gear housing into a rotationally driving connection with said gear assembly, a rider member connected in driving relation to the canopy assembly; said rider member mounted on an exterior surface of said one drive gear in driven in engagement there with, at least one cord connected to said rider member, and interconnecting said rider member to the canopy assembly, said one cord disposed in spaced relation relative to said drive gear, said one rider member linearly movable in opposite directions along the length of said one drive gear, dependent on a direction of rotation of said drive gear and crank handle relative to said gear assembly, said at least one cord linearly movable in opposite directions along the length of said one drive gear dependent on a direction of movement of said rider member, and in non-winding relation with said one drive gear, concurrent, cooperative directions of linear movement of said rider member and said at least one cord and rotational movement of said drive gear and said crank handle being determinative of the positioning of the canopy assembly in the open orientation or the closed orientation, said gear housing including two housing segments connected to one another within the interior of the mast in at least partially enclosing relation to said gear assembly, each of said housing segments including an access opening disposed and dimensioned to movably receive a portion of said crank handle there through in driving connection with said gear assembly, said gear assembly comprising a first pair of bevel gears, wherein at least one of said first pair of bevel gears is interconnected in rotationally driven relation to said crank handle, and said gear assembly comprising a second pair of bevel gears each connected in intermeshing, driven relation with said one bevel gear of said first pair of bevel gears.

25. The assembly as recited in claim 24 wherein either of said first pair of bevel gears is connected to and rotationally driven by said crank handle.

* * * * *